US008534779B2

(12) United States Patent
Schaaf

(10) Patent No.: US 8,534,779 B2
(45) Date of Patent: Sep. 17, 2013

(54) PORTABLE STATION

(76) Inventor: Kenneth Schaaf, Minneapolis, MN (US)

( * ) Notice: Subject to any disclaimer, the term of this patent is extended or adjusted under 35 U.S.C. 154(b) by 309 days.

(21) Appl. No.: 12/899,098

(22) Filed: Oct. 6, 2010

(65) Prior Publication Data

US 2012/0086316 A1 Apr. 12, 2012

(51) Int. Cl.
*A47B 97/00* (2006.01)

(52) U.S. Cl.
USPC ..... 312/272.5; 312/310

(58) Field of Classification Search
USPC ..... 312/21, 298, 310, 200, 271, 272, 312/272.5, 273–274, 319.4; 248/460, 461, 248/463, 458, 165, 166
See application file for complete search history.

(56) References Cited

U.S. PATENT DOCUMENTS

| | | | | | |
|---|---|---|---|---|---|
| 327,749 | A | | 10/1885 | Wulff | |
| 522,237 | A | | 7/1894 | Sexton | |
| 858,831 | A | * | 7/1907 | Sherman, Jr. | 312/200 |
| 949,485 | A | * | 2/1910 | Karay | 223/107 |
| 1,192,563 | A | * | 7/1916 | Rodrigues | 312/315 |
| 1,407,656 | A | * | 2/1922 | Jaynes | 312/325 |
| 1,867,710 | A | * | 7/1932 | Powell | 312/298 |
| 2,089,440 | A | * | 8/1937 | Sloan | 312/200 |
| 2,926,055 | A | * | 2/1960 | Mark | 312/21 |
| 3,086,830 | A | * | 4/1963 | Malia | 312/200 |
| 3,208,807 | A | * | 9/1965 | Becker | 312/200 |
| 3,512,707 | A | * | 5/1970 | Moldovan, Jr. | 235/51 |
| 3,904,853 | A | * | 9/1975 | Shoup et al. | 235/51 |
| 4,412,604 | A | | 11/1983 | Bell et al. | |
| 4,441,770 | A | * | 4/1984 | Brezosky | 312/276 |
| 4,740,044 | A | * | 4/1988 | Taylor | 312/196 |
| 4,832,193 | A | | 5/1989 | Kime | |
| 4,874,119 | A | | 10/1989 | Winter | |
| 4,949,843 | A | | 8/1990 | Stokes | |
| 4,953,601 | A | * | 9/1990 | Herdies | 144/285 |
| 5,242,056 | A | | 9/1993 | Zia et al. | |
| 5,265,719 | A | | 11/1993 | Wand | |
| 5,423,404 | A | | 6/1995 | Shaw | |
| 5,447,215 | A | | 9/1995 | Volkmar et al. | |
| 5,666,265 | A | | 9/1997 | Lutz et al. | |
| 5,676,223 | A | | 10/1997 | Cunningham | |
| 5,680,914 | A | * | 10/1997 | Reiser | 190/11 |
| 5,860,914 | A | | 1/1999 | Chiba et al. | |
| 5,984,092 | A | | 11/1999 | Heard-Willmon | |
| 6,068,355 | A | | 5/2000 | Thorp | |
| 6,371,581 | B1 | * | 4/2002 | Ring et al. | 312/138.1 |
| 6,530,475 | B1 | | 3/2003 | Penney | |
| 6,578,938 | B2 | * | 6/2003 | Norman et al. | 312/290 |
| 6,634,668 | B2 | * | 10/2003 | Urffer et al. | 280/651 |
| 7,593,222 | B2 | | 9/2009 | Zbikowski | |
| 2004/0226791 | A1 | | 11/2004 | Levy | |
| 2006/0250057 | A1 | * | 11/2006 | Vasudeva | 312/271 |
| 2008/0023283 | A1 | | 1/2008 | Sutker et al. | |
| 2008/0185945 | A1 | | 8/2008 | Low | |

FOREIGN PATENT DOCUMENTS

EP 0442479 A1 8/1991

* cited by examiner

*Primary Examiner* — Hanh V Tran
(74) *Attorney, Agent, or Firm* — Leffert Jay & Polglaze, P.A.

(57) ABSTRACT

In an embodiment, a portable station has an open enclosure and a chest having first and second cases pivotally coupled to each other. When the portable station is in a first configuration, the chest is closed and is selectively fastened at a first location within the enclosure. When the portable station is in a second configuration, the chest is open and selectively fastened at a second location within the enclosure. When the chest is open, the first and second cases have been pivoted apart.

27 Claims, 13 Drawing Sheets

PORTABLE STATION

FIELD

The present disclosure relates generally to stations, such as display stations or workstations, and, in particular, in one or more embodiments, the present disclosure relates to portable stations.

BACKGROUND

Portable chests are sometimes used to transport items from one location to another. For example, a portable chest, such as a portable tool chest, may be used to transport tools to a jobsite. However, the tools can be hard to locate within some portable tool chests and can become disorganized at the jobsite.

Sometimes portable chests are used to transport items to a location for display, e.g., on tables. However, items can be difficult to organize on tables and can be difficult to view on tables, e.g., especially when there is a large number of items and/or when there are different types of items.

SUMMARY

An embodiment herein provides a portable station with an open enclosure and a chest having first and second cases pivotally coupled to each other. When the portable station is in a first configuration, the chest is closed and is selectively fastened at a first location within the enclosure. When the portable station is in a second configuration, the chest is open and selectively fastened at a second location within the enclosure. When the chest is open, the first and second cases have been pivoted apart.

DETAILED DESCRIPTION

Figure 1:
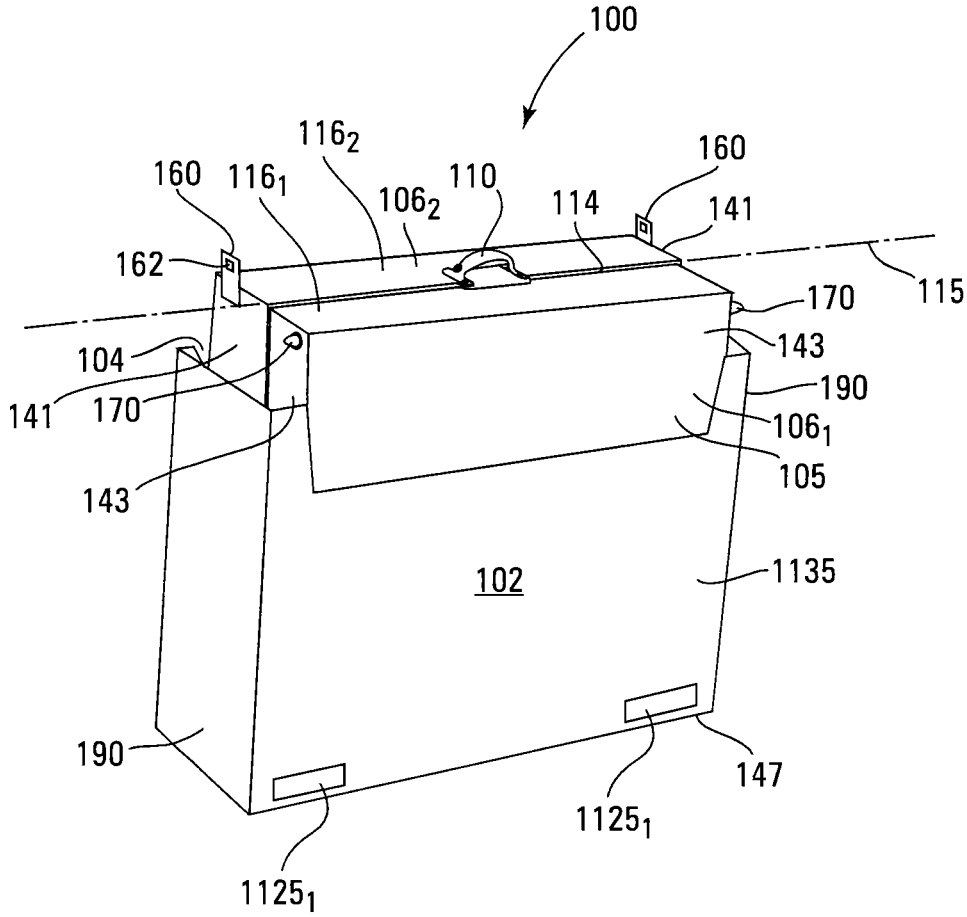
FIG. 1, illustrates a portable station in a portable, closed configuration, according to an embodiment.

In the following detailed description, reference is made to the accompanying drawings that form a part hereof, and in which is shown, by way of illustration, specific embodiments. In the drawings, like numerals describe substantially similar components throughout the several views. Other embodiments may be utilized and structural and/or electrical changes may be made without departing from the scope of the present disclosure. The following detailed description is, therefore, not to be taken in a limiting sense.

FIGS. 1-4 illustrate a portable station 100, such as a portable workstation or a portable display station, according to an embodiment. FIGS. 1-4 sequentially show portable station 100 at various stages of being converted (e.g., opening), such as by unfolding, from a portable, closed configuration in FIG. 1 to an open configuration (e.g., that may be called a station configuration) in FIG. 4. Conversely, FIGS. 4-1 sequentially show portable station 100 at various stages of being converted (e.g., closing), such as by folding, from the open configuration in FIG. 4 to the closed, portable configuration in FIG. 1.

Portable station 100 may include an open enclosure (e.g., housing) 102 having an opening 104 in its top. A closed chest 105 may be located at an elevation within enclosure 102 when portable station 100 is in the portable configuration, as shown in FIG. 1. For example, a portion of closed chest 105 may be contained within enclosure 102, while another portion may extend though opening 104 above the top of enclosure 102. Enclosure 102 may act a support base, e.g., that acts to prevent portable station 100 from falling over or being easily knocked over when portable station 100 is in the open configuration of FIG. 4. For some embodiments, enclosure 102 and the exterior of chest 105 may be formed from a hard, non-compliant material, such as metal, e.g., aluminum, steel, etc., hard plastic, wood, or the like.

Figure 2:
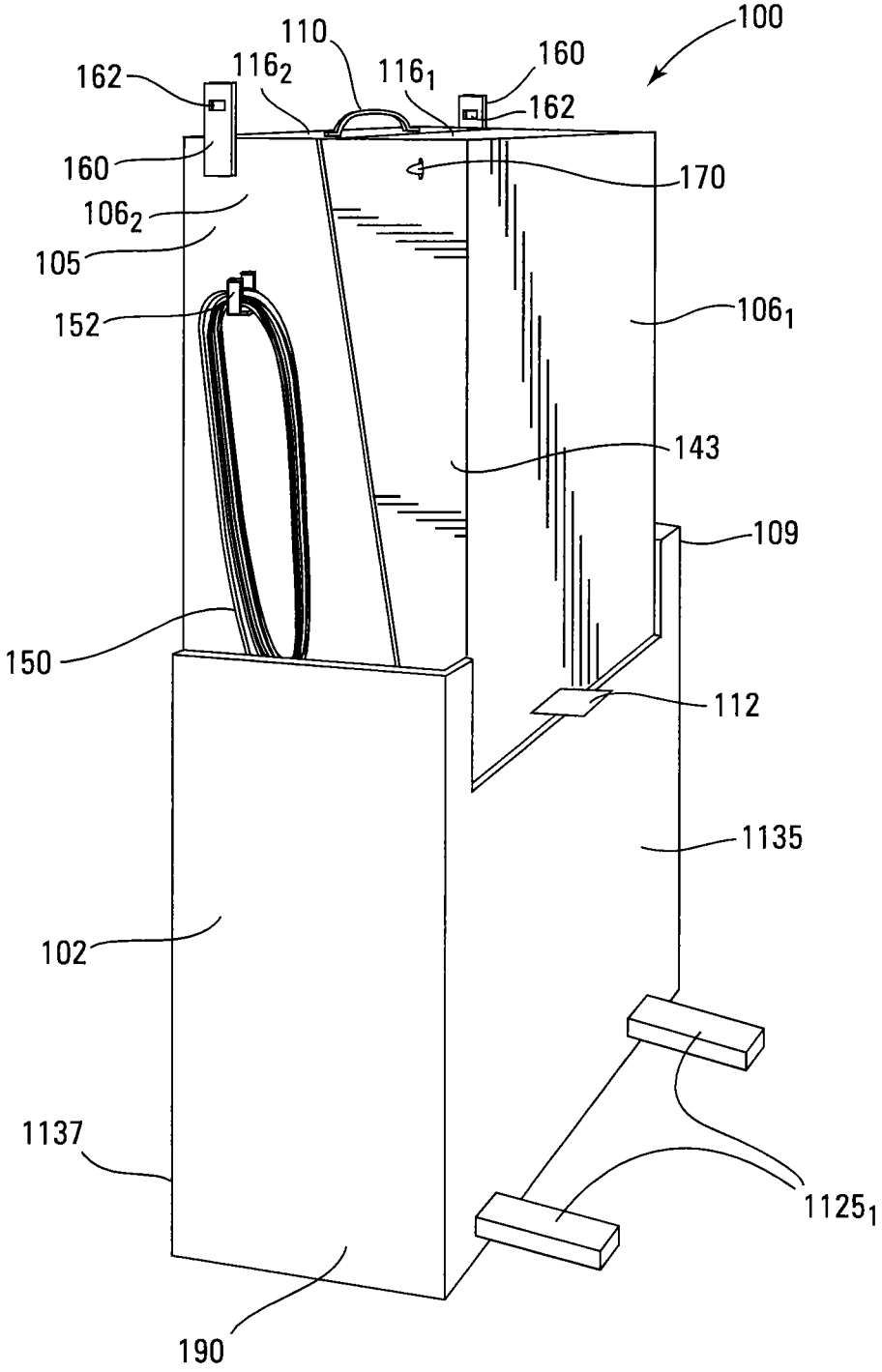
FIG. 2 illustrates a portable station at a stage of being converted from one configuration to another, according to another embodiment.

FIG. 2 shows closed chest 105 after it has been moved (e.g., by pulling), e.g., using a handle 110 attached to chest 105, to another elevation within enclosure 102 that enables chest 105 to be opened (e.g., expanded). Handle 110 may also be used to lift portable station 100 for transporting portable station 100 when portable station 100 in the portable configuration in FIG. 1.

A handle 112 (e.g., a tab of flexible material, such as fabric, nylon web, leather, etc.) may be attached to chest 105, as shown in FIG. 2, for opening chest 105. Making handle 112 out of a flexible material enables handle 112 to be folded substantially flat against chest 105 when chest 105 is located at the elevation within enclosure 102 corresponding to the portable configuration of station 100, as shown in FIG. 1. Alternatively, a handle, e.g., similar to handle 110, may be recessed below the exterior surface of chest 105, e.g., at substantially the location as shown for handle 112 in FIG. 2, so as not to obstruct the movement of chest 105 relative to enclosure 102.

Pulling on handle 112 acts to separate a case $\mathbf{106}_1$, e.g., an open case, of chest 105 from a case $\mathbf{106}_2$, e.g., an open case, of chest 105, thereby opening chest 105. For example, for some embodiments, case $\mathbf{106}_1$ may be pivotally attached case $\mathbf{106}_2$, e.g., by a hinge 114 (FIG. 4), and pulling on handle 112 causes case $\mathbf{106}_1$ to pivot (e.g., about a pivot axis 115 (FIG. 4)) relative to case $\mathbf{106}_2$ in a direction so that a front of case $\mathbf{106}_1$ moves away from a front of case $\mathbf{106}_2$, as shown in FIG. 3.

Figure 3:
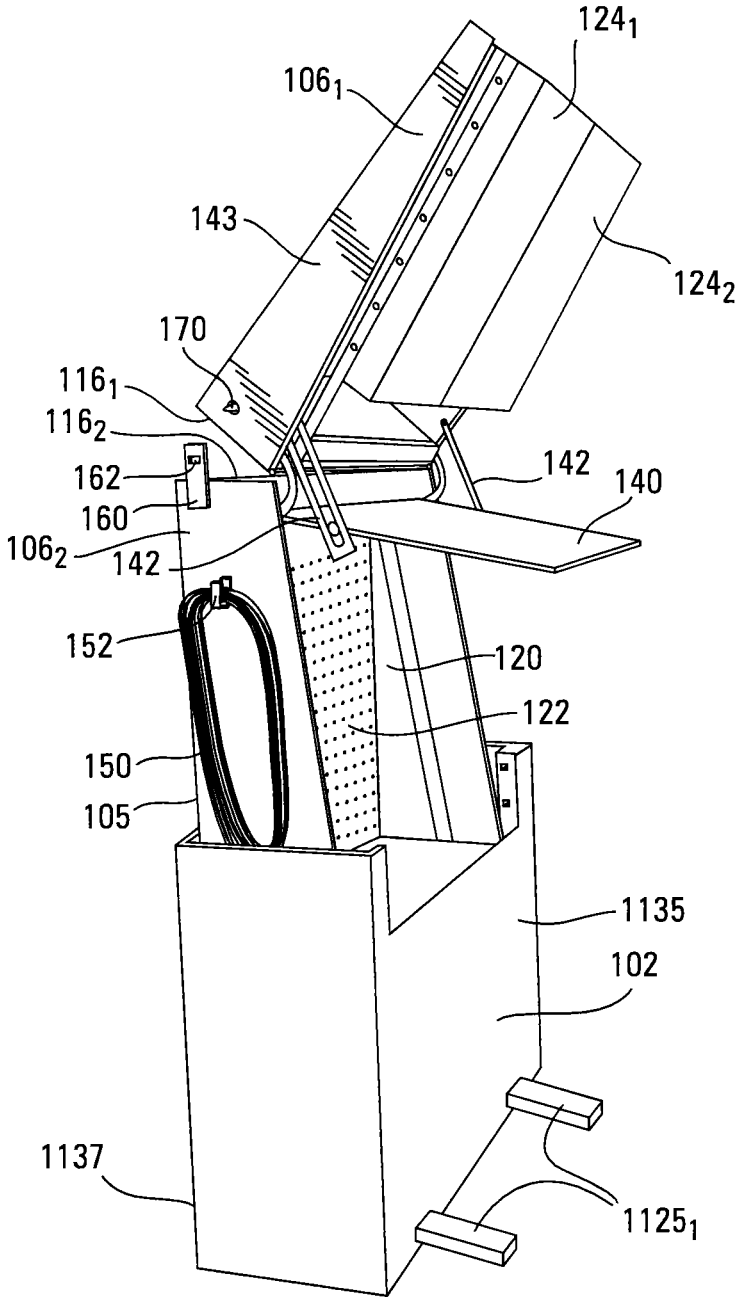
FIG. 3 illustrates a portable station at another stage of being converted from one configuration to another, according to another embodiment.
Figure 4:
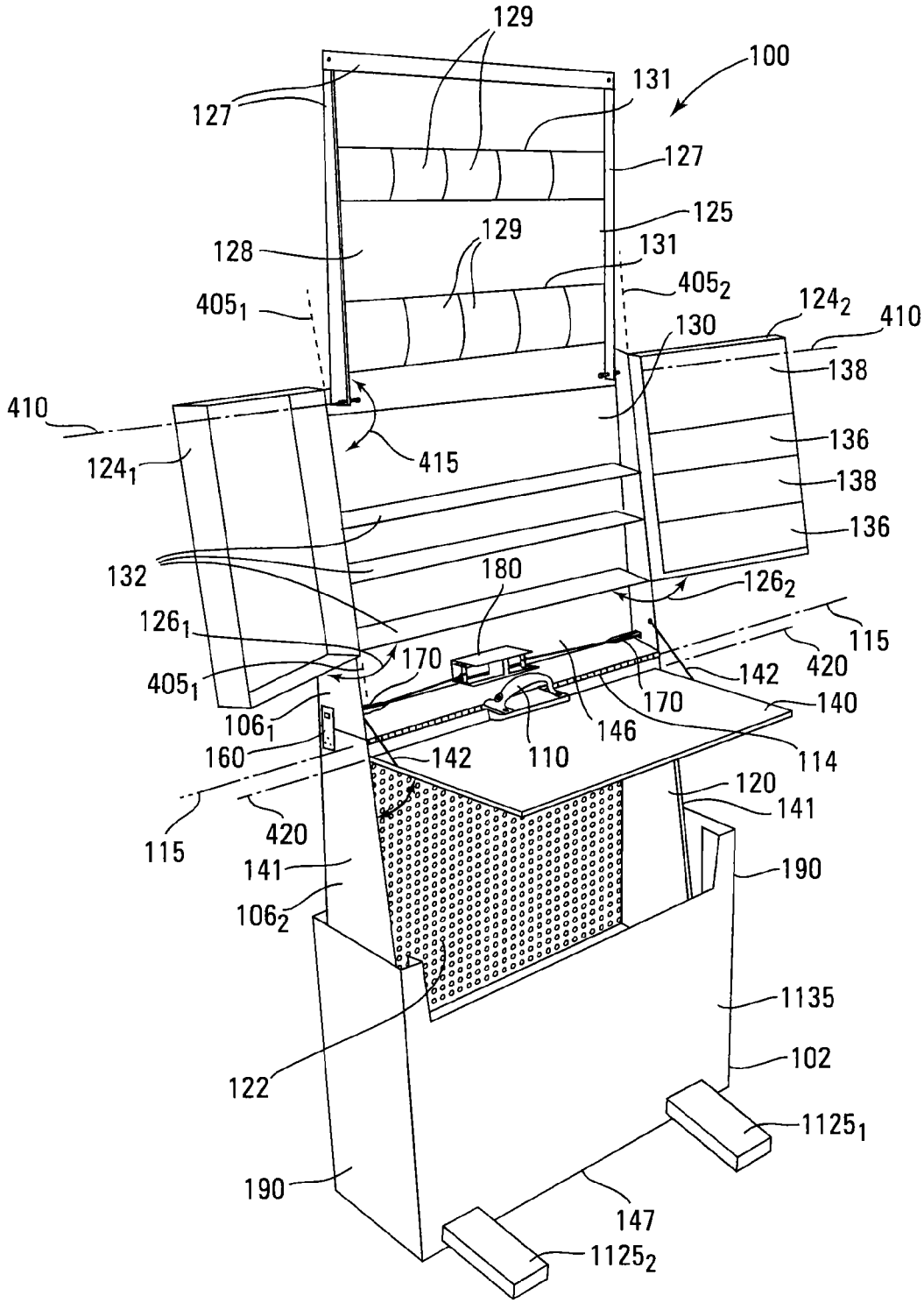
FIG. 4 illustrates a portable station in an open configuration, according to another embodiment.

Continued pivoting of case $\mathbf{106}_1$ relative to case $\mathbf{106}_2$ causes a surface $\mathbf{116}_1$ of case $\mathbf{106}_1$ that was upward facing when chest 105 was closed, as shown in FIGS. 1 and 2, to become inverted (FIG. 3). Surface $\mathbf{116}_1$ of case $\mathbf{106}_1$ faces downward toward an upward-facing surface $\mathbf{116}_2$ (FIGS. 1-3)

of case $106_2$ and may contact upward-facing surface $116_2$ when station 100 is in the open configuration of FIG. 4. That is, when surface $116_1$ of case $106_1$ contacts upward-facing surface $116_2$ upward-facing surface $116_2$ prevents case $106_1$ from being pivoted further in the direction that moves the front of case $106_1$ moves away from the front of case $106_2$. Note that upward-facing surfaces $116_1$ and $116_2$ form portions of an upper surface of the closed chest 105, as shown in FIGS. 1 and 2.

Case $106_2$ may include a compartment 120 that is exposed when station 100 is in the open configuration, as shown in FIG. 4. For example, compartment 120 is open compartment when station 100 is in the open configuration. Compartment 120 may be configured to contain tools or items for display. In some embodiments, a pegboard 122 may be located within compartment 120 for receiving hooks or the like that can be used to hang the tools or items for display therefrom.

A pair of cases $124_1$ and $124_2$ may be pivotally attached to case $106_1$, as shown in FIGS. 3 and 4, so that they can respectively pivot about substantially parallel pivot axes $405_1$ and $405_2$ that may be inclined from vertical. For example, cases $124_1$ and $124_2$ may be respectively pivotally attached to opposing sidewalls of case $106_1$. Exterior surfaces of cases $124_1$ and $124_2$ are exposed when case $106_1$ is pivoted relative to case $106_2$, as shown in FIG. 3. Cases $124_1$ and $124_2$ may be respectively pivoted relative to case $106_1$, as indicated by arrows $126_1$ and $126_2$.

Pivoting cases $124_1$ and $124_2$ in directions that cause the fronts of cases $124_1$ and $124_2$ to move away from a front of case $106_1$ exposes interiors of cases $124_1$ and $124_2$ and an interior of a compartment 130 within case $106_1$, as shown in FIG. 4. Compartment 130 is an open compartment when cases $124_1$ and $124_2$ are pivoted away from the front of case $106_1$. Compartment 130 may include one or more shelves 132.

When 105 is open and station 100 is in its open configuration, case $106_1$, and thus compartment 130, is stacked substantially vertically (e.g., vertically) above case $106_2$ and thus compartment 120.

The exterior surfaces of compartments $124_1$ and $124_2$ close a portion of compartment 130 when compartments $124_1$ and $124_2$ are located in front of that portion of compartment 130, as shown in FIG. 3. Shelves 132 may be covered by cases $124_1$ and $124_2$ when cases $124_1$ and $124_2$ are located in front of compartment 130. Cases $124_1$ and $124_2$ may be removably coupled to a shelf 132 when compartments $124_1$ and $124_2$ cover shelves 132, e.g., by a latch.

For some embodiments, a pocket assembly 125 may cover at least a portion of the front of compartment 130, and pocket assembly 125 may in turn be covered by cases $124_1$ and $124_2$ when cases $124_1$ and $124_2$ are located in front of compartment 130, i.e., when cases $124_1$ and $124_2$ are positioned as shown in FIG. 3. Stated another way, when cases $124_1$ and $124_2$ are located in front of compartment 130, pocket assembly 125 may be interposed between cases $124_1$ and $124_2$ and the front edges of shelves 132 of compartment 130.

Pocket assembly 125 may be pivotally coupled to interior surfaces of the opposing sidewalls of case $106_1$. Pivoting compartments $124_1$ and $124_2$ open to expose their interiors exposes pocket assembly 125. Pocket assembly 125 may be pivoted relative to case $106_1$ in the direction of arrows 415.

Pocket assembly may include a frame 127 and a sheet 128 of compliant material, such as vinyl, attached to frame 127. It is the frame 127 that may be pivotally coupled to the interior surfaces of the opposing sidewalls of case $106_1$ so that frame 127 can pivot about a pivot axis 410, e.g., that may be substantially parallel with the pivot axis 115 about which case $106_1$ pivots. Sheet 128 may include a plurality of pockets 129. A resilient material 131, such as elastic fabric, may be located adjacent to the openings to pockets 129. Resilient material 131 may act to keep the openings to the pockets closed.

Figure 5:
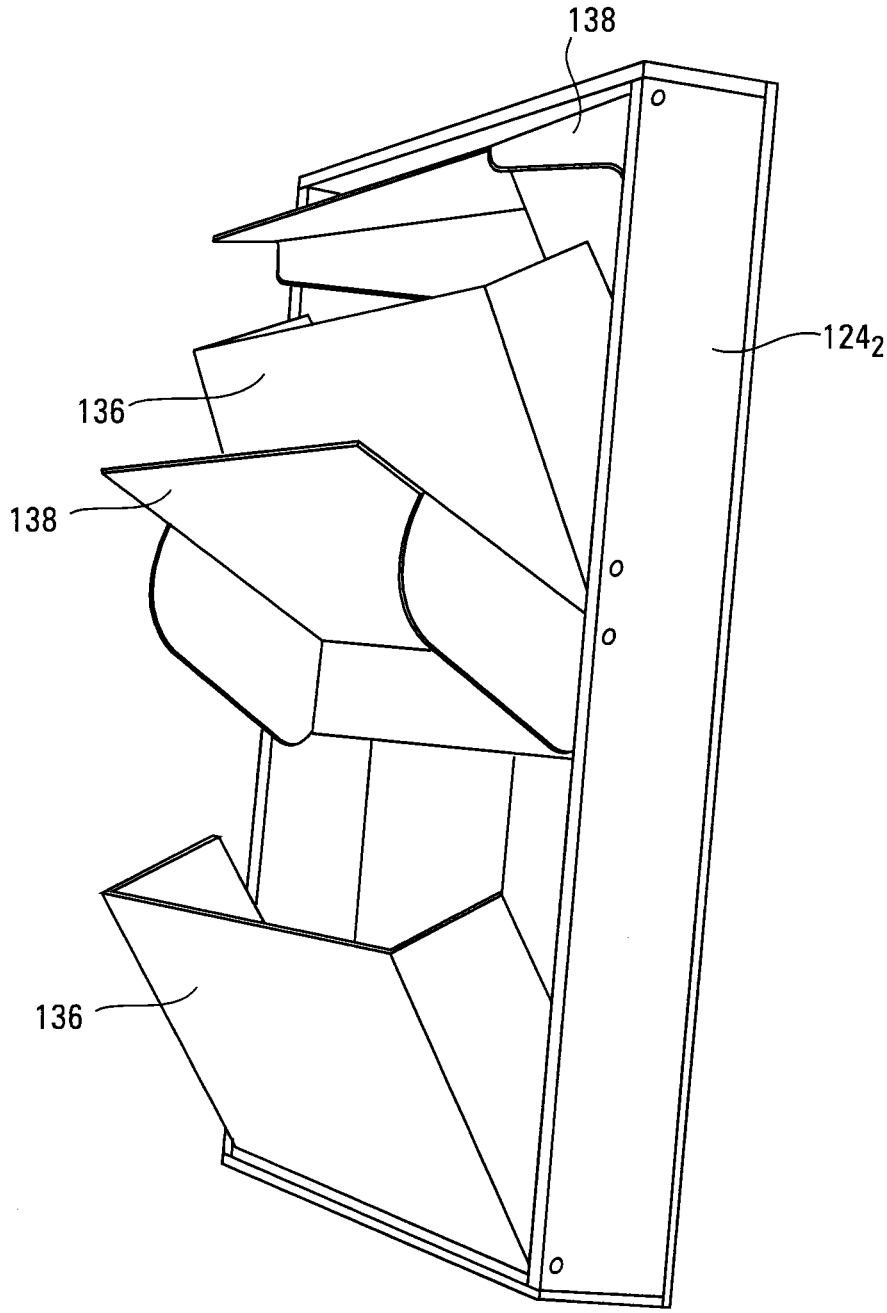
FIG. 5, illustrates containers in a case of a portable station, according to another embodiment.

Case $124_2$ may include containers 136 that may be pivotally coupled to the interior of opposing sidewalls of case $124_2$ so that containers 136 can pivot out of case $124_2$, as shown in FIG. 5. Covers 138 may be pivotally coupled to the interior of opposing sidewalls of case $124_2$. For some embodiments, when containers 136 are pivoted into case $124_2$, a cover 138 may be pivoted to overlap a portion of each container 136, as shown in FIG. 4. For other embodiments, case $124_1$ may be configured substantially the same (e.g., the same) as case $124_2$, and thus may include containers 136 that may be pivotally coupled to the interior of opposing sidewalls of case $124_1$ so that containers can pivot out of case $124_1$, and may include a cover 138 that can be pivoted to overlap a portion of each container 136.

A sheet of material, such as a panel, e.g., a table 140, that may be metal, e.g., aluminum, steel, etc., hard plastic, wood, or the like, may be pivotally coupled to interior surfaces of opposing sidewalls 141 of case $106_2$, and thus of compartment 120, e.g., using pins (not shown). Table 140 may pivot about a pivot axis 420 that may be substantially parallel to the pivot axis 115 about which case $106_1$ pivots. Supports 142 may connect table 140, e.g., at its sides, to the interior of opposing sidewalls of case $106_1$ within a portion 146 of compartment 130, as shown in FIGS. 3 and 4. For some embodiments, portion 146 of compartment 130 is not covered by cases $124_1$ and $124_2$.

Figure 6:
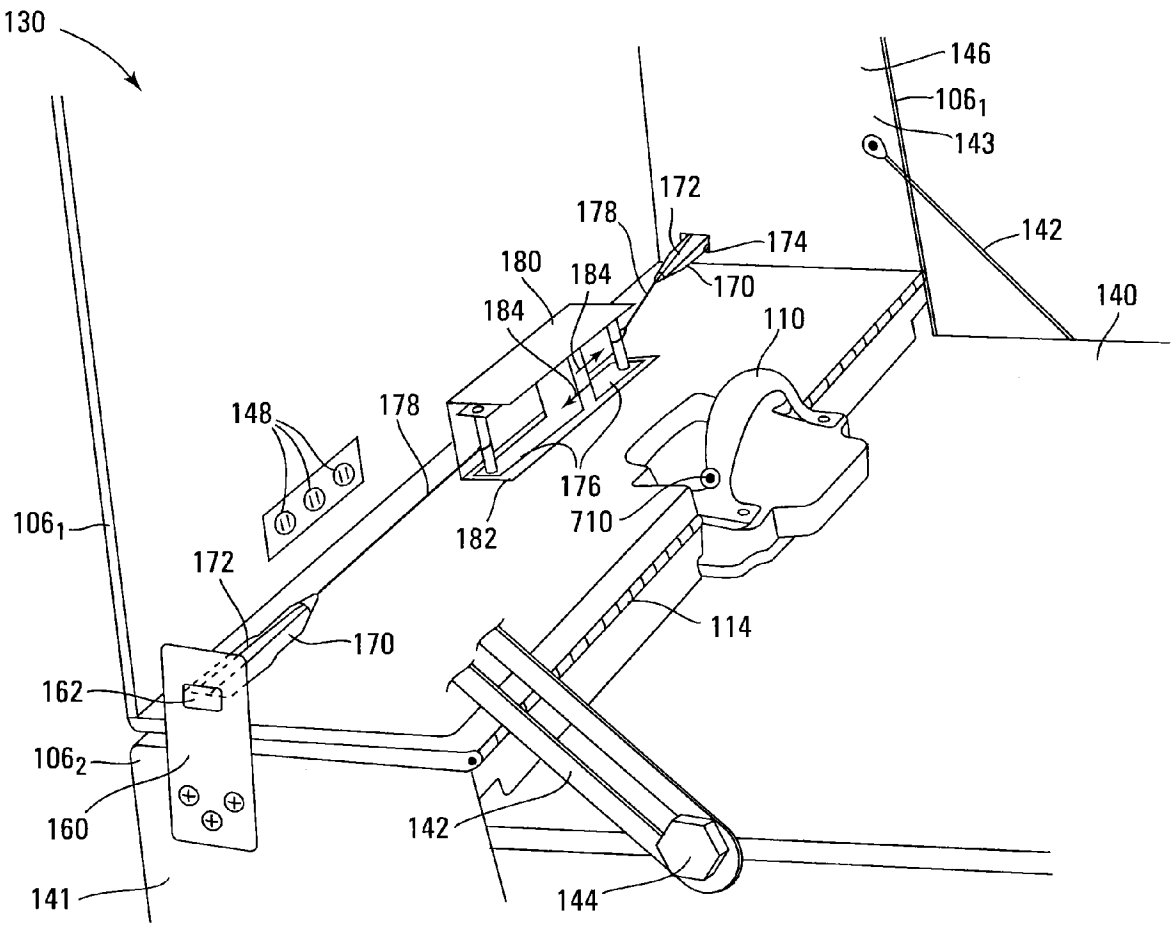
FIG. 6 is a cut-away view of a portion of a case of a portable station, according to another embodiment.

For some embodiments, supports 142 may be cables, as shown in FIG. 4. For other embodiments, at least one of supports 142 may be a slotted, substantially rigid bar, e.g., of metal, as shown in FIGS. 3 and 6, where FIG. 6 is a cut-away view of case $106_1$ showing the interior of portion 146 of compartment 130. The slotted bar may be pivotally coupled to table 140 and case $106_1$, e.g., by a fasteners, such as screws (e.g., screw 144 in FIG. 6) or bolts so that the fasteners can rotate within the slot of the slotted bar.

Supports 142 maintain table 140 in a first position so that the upper surface of table 140 and a bottom surface 147 of case 102, e.g., the base surface of portable station 100, respectively lie in substantially parallel planes and table 140 extends outward from the interior of chest 105 when chest 105 is open. That is, table 140 extends outward from compartment 120 when portable station 100 is in the open configuration of FIG. 4. For example, table 140 may be maintained substantially horizontal when the bottom surface 147 of case 102 is substantially horizontal, as in FIG. 4, and when portable station 100 is in the open configuration. When table 140 is in its first position, table 140 may function as a workbench, for example.

When chest 105 is closed, such as when portable station 100 is in the closed, portable configuration of FIG. 1 or the configuration of FIG. 2, table 140 is enclosed within chest 105 in a second position. When table 140 is in the second position, its upper surface is substantially perpendicular to the bottom surface 147 of case 102. That is, the upper surface of table 140 is substantially vertical when enclosed within chest 105, when the bottom surface 147 of case 102 is substantially horizontal.

Pivoting case $106_1$ relative to case $106_2$ so that the front of case $106_1$ separates from and moves away from the front of case $106_2$, causes table 140 to pivot from its second position to its first position. For example, as the front of case $106_1$ separates from and moves away from the front of case $106_2$, case $106_1$ exerts a force on supports 142, which in turn exert a force (e.g., a pulling force) on table 140 that causes table 140 to pivot from its second position to its first position. In other words, table 140 pivots from its second position to its first position substantially concurrently (e.g., concurrently) with case $\mathbf{106}_1$ as chest 105 is being opened. For example, table 140 may pivot from its second position to its first position in response to opening chest 105.

Pivoting case $\mathbf{106}_1$ relative to case $\mathbf{106}_2$ so that the front of case $\mathbf{106}_1$ moves from its position in FIG. 4 toward front of case $\mathbf{106}_2$, causes table 140 to pivot from its first position to its second position. For example, pivoting case $\mathbf{106}_1$ in this way acts to substantially remove a force exerted by supports 142 that acts to maintain table 140 in its first position, allowing gravitational force to cause table 140 to pivot from its first position to its second position. In other words, table 140 pivots from its first position to its second position in response to closing chest 105.

Alternatively, for embodiments where one or both of supports 142 are slotted bars, as shown in FIG. 6 for one slotted bar, the slotted bar may pivot with case $\mathbf{106}_1$ and may exert a force on table 140 may act to assist or mitigate the effect of gravitational force on table 140. For example, mitigating the effect of gravitational force on table 140 may act to prevent table 140 from essentially "free falling" when pivoting case $\mathbf{106}_1$ causes table 140 to pivot from its first position to its second position. As such, table 140 may pivot substantially concurrently (e.g., concurrently) with case $\mathbf{106}_1$ as chest 105 is being closed.

For some embodiments, one or more electrical outlets, such as electrical outlets 148, may be located on an interior surface of compartment 130 (FIG. 6) on the exterior of enclosure 102, and/or on an interior surface of compartment 120. The electrical outlets may be coupled to an AC electrical source, e.g., using an electrical cord 150 that may be hung on a hook 152 that may be attached to an outer surface of case $\mathbf{106}_2$, such as an outer surface of a sidewall of case $\mathbf{106}_2$, as shown in FIGS. 2 and 3.

For some embodiments, a pair of plates 160 having openings 162 therethrough (e.g., that may be called striker plates) may be attached to case $\mathbf{106}_2$, as shown in FIGS. 1, 2, 3, 4, and 6. For example, plates 160 may be respectively attached to outer surfaces of the opposing sidewalls 141 of case $\mathbf{106}_2$ adjacent to the upper surface of case $\mathbf{106}_2$ so that there is one plate attached to each of opposing sidewalls 141.

A pair of pins 170 is located within the portion 146 of compartment 130, as shown in FIGS. 4 and 6. Each pin 170 is receivable through the opening 162 in a corresponding plate 160. Each pin 170 may be biased in a normally extended position by a biasing device 172, such as a rubber band, spring, etc., interposed between and coupled to the respective pin 170 and the interior of case $\mathbf{106}_1$, e.g., the interior surface of a sidewall 143 of case $\mathbf{106}_1$. Each pin 170 may be biased to extend from the interior of case $\mathbf{106}_1$ through an opening 174 in a corresponding sidewall 143 of case $\mathbf{106}_1$ (FIG. 6) and protrudes from an outer surface of the corresponding sidewall 143 (FIGS. 1-3).

Pins 170 are respectively coupled to actuators 176, such as slides, of a release mechanism 180 by linkages 178, such as cables, as shown in FIG. 6. As such, pins 170 are selectively actuatable by actuators 176. Release mechanism 180 may be located within the portion 146 of compartment 130, as shown in FIGS. 4 and 6. Actuators 176 may be slidably coupled to a housing 182 of release mechanism 180. The biasing forces exerted by biasing devices 172 on the respective pins 170 may exert pulling forces on the respective actuators 176 to bias them in the positions shown in FIG. 6.

As case $\mathbf{106}_1$ is pivoted into its position in FIG. 4, pins 170 respectively engage plates 160. The engagement between a pin 170 and a corresponding plate 160 deflects the pin 170 inward from its normally extended position against the biasing force of biasing device 172 and maintains pin 170 in its deflected position until the pin 170 aligns with the opening 162 in the corresponding plate 160. When the pin 170 aligns with the opening 162 in the corresponding plate 160, the biasing force forces the pin 170 through the opening 162 into its normally extended position, as shown in FIG. 6, thereby selectively latching case $\mathbf{106}_1$ to case $\mathbf{106}_2$. Latching case $\mathbf{106}_1$ to case $\mathbf{106}_2$ acts to prevent case $\mathbf{106}_1$ from being pivoted toward case $\mathbf{106}_2$.

To release (e.g., unlatch) case $\mathbf{106}_1$ from case $\mathbf{106}_2$, a user may slide (e.g., squeeze) actuators 176 toward each other in the direction of arrows 184, as shown in FIG. 6. Sliding an actuator 176 in the direction of an arrow 184 (e.g., in a direction away from the corresponding pin 170) causes the respective actuator 176 to exert a force (e.g., a pulling force) on the corresponding linkage 178, which in turn exerts a force (e.g., a pulling force) on the corresponding pin 170 that acts against the biasing force and moves (e.g., pulls) the corresponding pin 170 from the opening in a corresponding plate 160, thereby unlatching case $\mathbf{106}_1$ from case $\mathbf{106}_2$, allowing case $\mathbf{106}_1$ to be pivoted toward case $\mathbf{106}_2$, as a shown in FIG. 3, for closing chest 105. After case $\mathbf{106}_1$ is unlatched from case $\mathbf{106}_2$ and the user releases actuators 176, the respective biasing forces return pins to their normally extended position, with the respective pins 170 extending through their corresponding openings 174 and protruding from the respective sidewalls 143 of case $\mathbf{106}_1$. The respective biasing forces may also return the respective actuators 176 to their normal positions.

Figure 7:
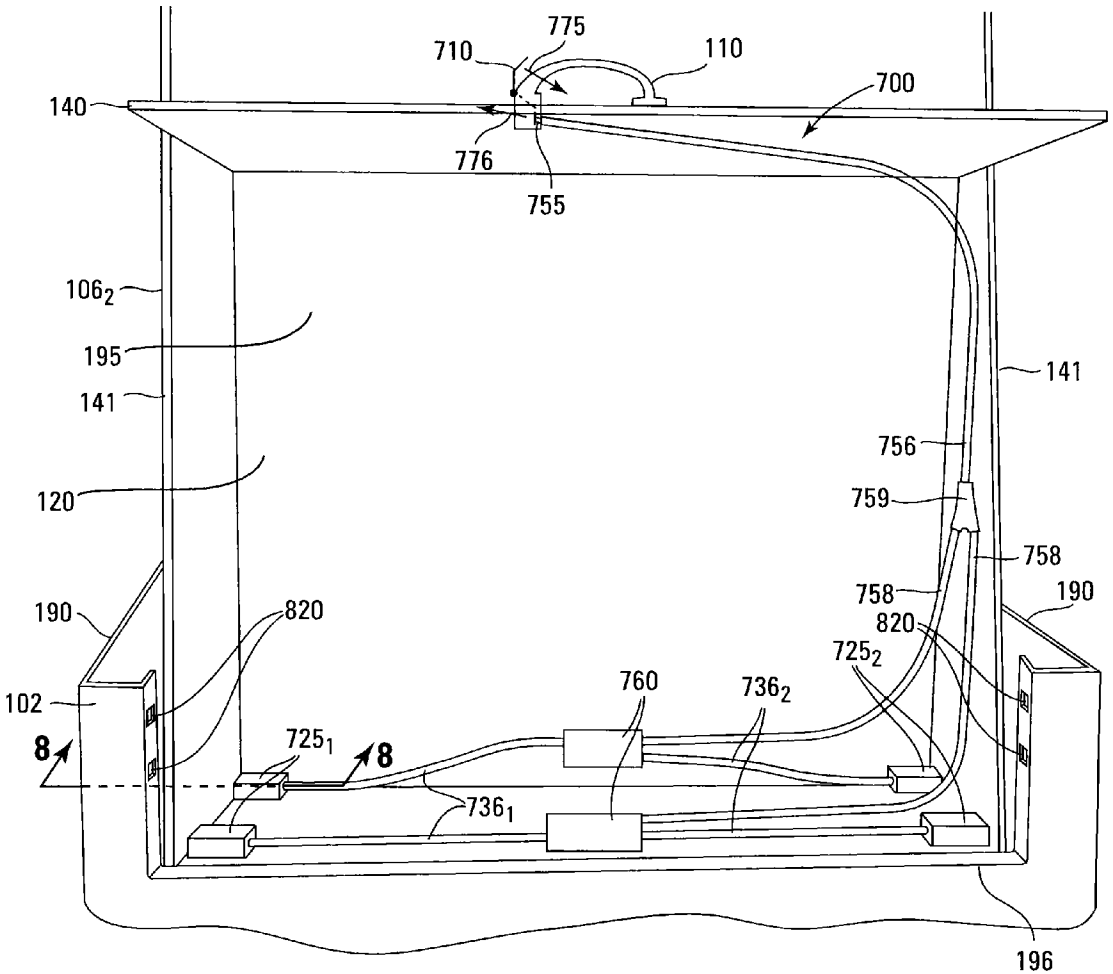
FIG. 7 illustrates a transfer system of a portable station, according to another embodiment.
Figure 8:
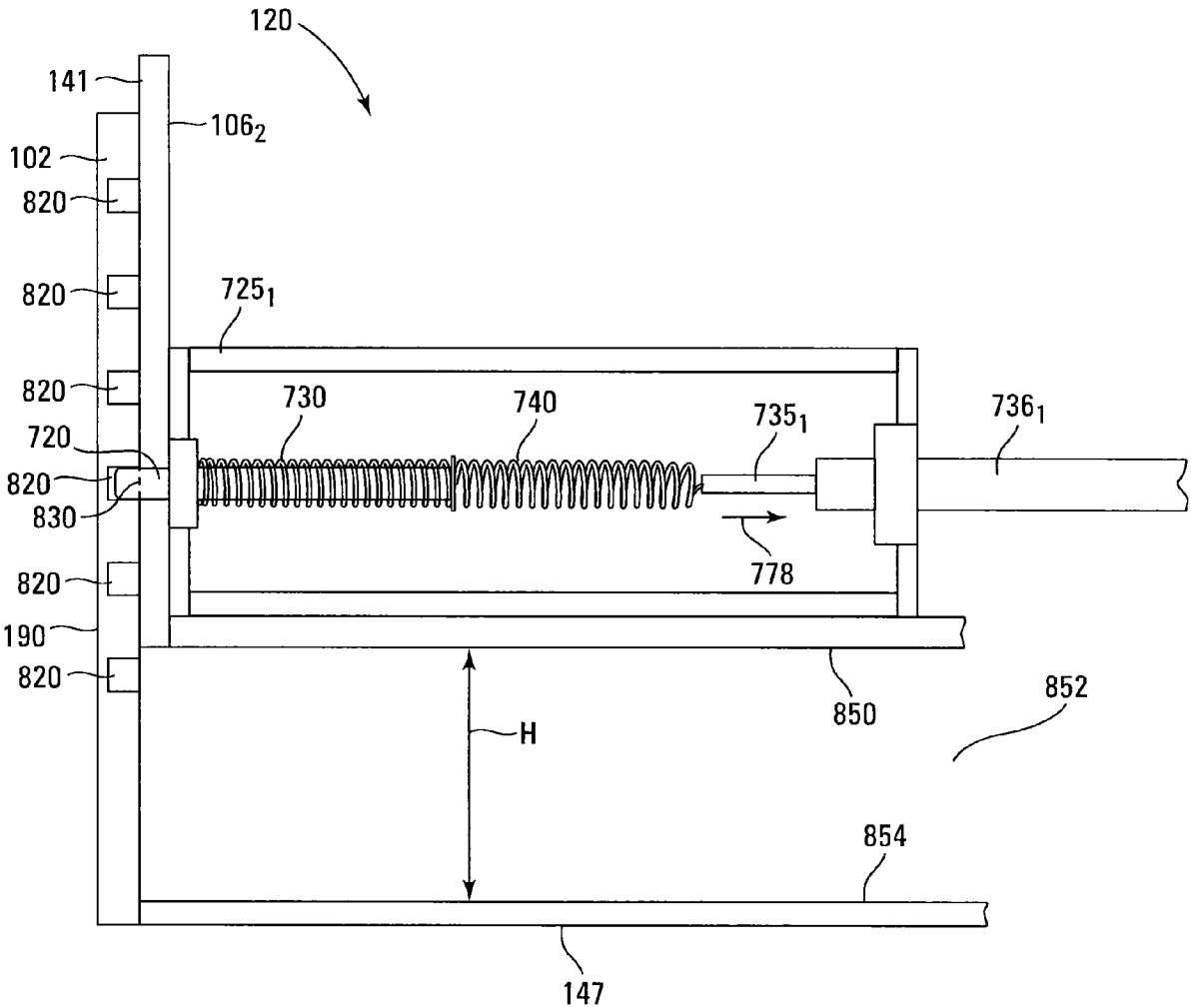
FIG. 8 is a cross-section viewed along line 8-8 of FIG. 7, according to another embodiment.

FIG. 7 is a view illustrating open compartment 120, e.g., with pegboard 122 removed, of case $\mathbf{106}_2$ after the front of case $\mathbf{106}_1$ has been pivoted away from the front of case $\mathbf{106}_2$ and after table 140 has pivoted to its first position and extends outward from compartment 120. FIG. 8 is a cross-section viewed along line 8-8 of FIG. 7, with cross-hatching and portions of the entire cross-section omitted for clarity.

A transfer system 700 may be located within compartment 120 of case $\mathbf{106}_2$. Transfer system 700 is configured to transfer the motion and/or force imparted to an actuator 710, such as a button or a lever, to a pin 720 extending from each of housings $\mathbf{725}_1$ and $\mathbf{725}_2$ of two pairs of housings $\mathbf{725}_1$ and $\mathbf{725}_2$, as shown in FIG. 8 for a housing $\mathbf{725}_1$, where one pair of housings $\mathbf{725}_1$ and $\mathbf{725}_2$ is located adjacent to a back-wall 195 of compartment 120 and the other pair of housings $\mathbf{725}_1$ and $\mathbf{725}_2$ is located adjacent to a front-wall 196 of enclosure 102 that has been cut away in FIG. 7 to show that pair of housings $\mathbf{725}_1$ and $\mathbf{725}_2$. For some embodiments, a portion of actuator 710 may be integrated within handle 110, as shown in FIG. 7.

A plurality of openings 820 (e.g., square or round holes) may be formed in each of opposing sidewalls 190 of open enclosure 102, e.g., terminating within the respective sidewall 190, as shown in FIGS. 7 and 8. Two substantially vertical sets of openings 820 may be formed in each sidewall 190. Each set of openings 820 may include a series of openings 820.

Two sets of openings 820 may be respectively located in opposing sidewalls 190 adjacent a back-wall of enclosure 102 respectively opposite the housings $\mathbf{725}_1$ and $\mathbf{725}_2$ of the pair of housings $\mathbf{725}_1$ and $\mathbf{725}_2$ located adjacent to back-wall 195 of compartment 120 for receiving a pin 720 from the respective housings $\mathbf{725}_1$ and $\mathbf{725}_2$, as shown in FIG. 8 for the housing $\mathbf{725}_1$ of that pair of housings. Two sets of openings 820 may be respectively located in opposing sidewalls 190 adjacent to the front-wall 196 of open enclosure 102 respectively opposite the housings $725_1$ and $725_2$ of the pair of housings $725_1$ and $725_2$ located adjacent to front-wall 196, as shown in FIG. 7, for receiving a pin 720 from the respective housings $725_1$ and $725_2$.

Each pin 720 may be biased to normally extend from its respective housing 725, by a biasing device (e.g., located in a respective housing 725), such as a spring 730, e.g., a coil spring, into one of openings 820 at a time of a respective set of openings 820. For example, when a pin 720 is biased in its normally extended position and is aligned with one of openings 820, that pin 720 extends from its respective housing 725, passes through an opening in a respective sidewall 141 of case $106_2$, and thus of compartment 120, and into the one of openings 820.

Pins 720 respectively extending from the housings $725_1$ and $725_2$ located adjacent to front-wall 196 of open enclosure 102 may extend into respective ones of the openings 820 of the sets of openings 820 shown adjacent to front-wall 196 in FIG. 7. Pins 720 respectively extending from the housings $725_1$ and $725_2$ located adjacent to the back-wall 195 of compartment 120 may extend into respective ones of the openings 820 of the sets of openings 820 adjacent to the back-wall of enclosure 102. By extending into respective openings 820, pins 720 selectively fasten case $106_2$ to enclosure 102.

Transfer system 700 may include cables $735_1$ (FIGS. 8 and 9) and cables $735_2$ (FIG. 9) that are respectively contained within cable housings $736_1$ and $736_2$. Cables $735_1$ may be respectively coupled to pins 720 extending from housings $725_1$, as shown in FIG. 8. In a similar manner, cables $735_2$ may be respectively coupled to pins 720 extending from housings $725_2$.

For some embodiments, a resilient device 740, such as a spring (e.g., a coil spring) a rubber band, elastic fabric, or the like, may be interposed between and connected to a pin 720 and a cable 735, such as a cable $735_1$ in FIG. 8. Alternatively, for other embodiments, resilient device 740 may be omitted, and a cable 735 may be coupled directly to a pin 720. Note that there may be one resilient device 740 located in each of the housings 725 and coupled to the pin 720 within the respective housing 725, meaning that there may be a plurality of resilient devices 740, where the resilient devices of the plurality of resilient devices 740 are coupled to pins 720 on a one-to-one basis.

A cable 755, contained within a cable housing 756, may be coupled to actuator 710. Cable 755 is coupled to cables 757 (FIG. 9 for one of the cables 757) within the cable housings 758 at a cable splitter 759.

Figure 9:
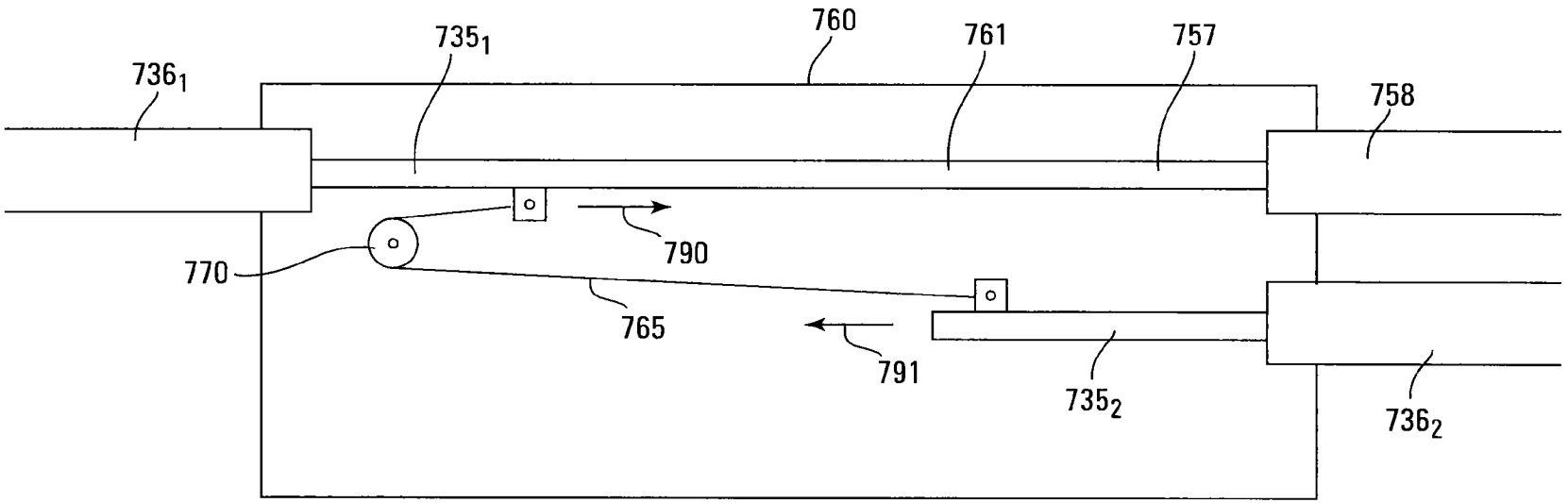
FIG. 9 illustrates an inverter of a transfer system of a portable station, according to another embodiment.

A cable 757 is coupled to the cables $735_1$ and $735_2$ that are respectively coupled to the pins 720 extending from the pair of housings $725_1$ and $725_2$ located adjacent to the back-wall 195 of compartment 120 and thus couples actuator 710 to those cables $735_1$ and $735_2$. For example, that cable 757 may be coupled to the respective cables $735_1$ and $735_2$ within an inverter 760, such as a tension inverter, of transfer system 700, as shown in FIG. 9.

Another cable 757 is coupled to the cables $735_1$ and $735_2$ that are respectively coupled to the pins 720 extending from the pair of housings $725_1$ and $725_2$ located adjacent to the front-wall 196 of open enclosure 102 and thus couples actuator 710 to the those cables $735_1$ and $735_2$. For example, that cable 757 may be coupled to the respective cables $735_1$ and $735_2$ within another tension inverter 760 of transfer system 700, as shown in FIG. 9.

A cable 757 may be coupled directly to a cable $735_1$ to form a single cable 761. Alternatively, single cable 761 may be a single continuous cable having a cable $735_1$ and a cable 757 as portions thereof, as shown in FIG. 9. Cable $735_2$ may be coupled to cable 761 by a strip 765 of material, such as a fabric web, leather, etc. Strip 765 may wrap around a pulley 770 of inverter 760 located between cable 761 and cable $735_2$.

When a user imparts motion and/or force to actuator 710 in the direction of arrow 775, as shown in FIG. 7, actuator 710 imparts a motion and/or force to cable 755, causing cable 755 to move (e.g., actuator 710 pulls on cable 755) in the direction of arrow 776, placing cable 755 in tension. The cable 755 imparts a motion and/or force to each of cables 757 substantially concurrently (e.g. concurrently) at cable splitter 759. The cables 757 respectively impart a motion and/or force to cables $735_1$, causing those cables $735_1$ to move in the direction of arrow 778, as shown in FIG. 8.

The cables $735_1$ respectively impart motion and/or force to pins 720 respectively extending from housings $725_1$ substantially concurrently (e.g., concurrently), causing them to move substantially concurrently (e.g., concurrently), in the direction of arrow 778, against the biasing force exerted by the respective biasing devices 730, so that the tips of the respective pins 720 are retracted to at least being substantially flush with the outer surface of the corresponding sidewall 141 of case $106_2$, as indicated by dashed line 830 in FIG. 8, thereby releasing the respective pins 720 from open enclosure 102.

For embodiments where a resilient device 740 is coupled between a cable $735_1$ and a corresponding pin 720, when cable $735_1$ moves in the direction of arrow 778, the motion of cable $735_1$ causes cable $735_1$ to exert a force on the resilient device 740 that stretches resilient device 740, causing the resilient device 740 to exert a force on the corresponding pin 720. The force exerted by resilient device 740 acts to retract the corresponding pin 720. If a pin 720 happens to stick, for example, resilient device 740 can maintain the force on the stuck pin 720, while a user keeps actuator 710 in its actuated position, while the user moves chest 105 to reduce friction on the stuck pin 720, and when the friction is sufficiently reduced, the force exerted by resilient device 740 acts to retract the pin 720.

Cable 755 imparts motion and/or force to the respective strips 765 (one in each inverter 760) and to respective cables $735_1$ substantially concurrently (e.g., concurrently), causing the respective strips 765 to move in the direction of arrow 790, as shown in FIG. 9, around the respective pulleys 770. Note that the direction of the motion of the portion of a strip 765 on one side (e.g., the input side) of pulley 770, as indicated by arrow 790, is different than (e.g., substantially opposite to) the direction of the motion of the portion of that strip 765 on the other side (e.g., the output side) of pulley 770, as indicated by arrow 791. The motion (e.g., the reversed motion) of the portions of the respective strips 765 on the output side of the respective pulleys 770 is in turn imparted to the respective cables $735_2$ substantially concurrently (e.g., concurrently), causing the respective cables $735_2$ to move in the direction of arrow 791, as shown in FIG. 9 for one of the respective cables $735_2$. This causes the respective pins 720, extending from the respective housings $725_2$, to move against the biasing force exerted by the respective biasing devices 730, so that the tips of the respective pins 720 are retracted to at least being substantially flush with the outer surface of the corresponding sidewall 141 of case $106_2$, thereby releasing the respective pins 720 from open enclosure 102. That is, the pins 720 respectively extending from housings $725_1$ and $725_2$ may selectively retract substantially concurrently (e.g., concurrently) in response to the motion imparted to actuator 710, thereby releasing (e.g., unfastening) chest 105, whether opened or closed, from enclosure 102.

Note that the presence of pulley 770 in an inverter 760 acts to change (e.g., substantially reverse) the direction of motion of cable 757 input to that tension inverter 760 for an output to a housing $\mathbf{725}_2$. Therefore, an inverter 760 receives an input motion from actuator 710 via a cable 757 in the direction of arrow 790, outputs a motion in the direction of arrow 790 to a housing $\mathbf{725}_1$ via a cable $\mathbf{735}_1$, changes (e.g. reverses) the input motion from actuator 710 to a motion in the direction of arrow 791, and outputs a motion in the direction of arrow 791 to a housing $\mathbf{725}_2$ via a cable $\mathbf{735}_2$. Note that the motion received at a housing $\mathbf{725}_2$ may be in a direction that is substantially the reverse of the motion received at a housing $\mathbf{725}_1$ because housings $\mathbf{725}_1$ and $\mathbf{725}_2$ face in substantially opposite directions, and their respective pins 720 extend in substantially opposite directions into opposing sidewalls 190 of open enclosure 102.

Stated another way, a tension inverter 760 receives an input force from actuator 710 via a cable 757 in the direction of arrow 790, outputs the received input force without changing the direction of the received input force to a pin 720 extending from a housing $\mathbf{725}_1$ via a cable $\mathbf{735}_1$ and outputs the received input force with a changed direction, e.g., the direction of arrow 791, to a pin 720 extending from a housing $\mathbf{725}_2$ via a cable $\mathbf{735}_2$.

For embodiments where a resilient device 740 is coupled between a cable $\mathbf{735}_2$ and a corresponding pin 720, when cable $\mathbf{735}_2$ moves in the direction of arrow 791, the motion of cable $\mathbf{735}_2$ causes cable $\mathbf{735}_2$ to exert a force on the resilient device 740 that stretches resilient device 740, causing the resilient device 740 to exert a force on the corresponding pin 720 that retracts the corresponding pin 720.

Note that in the event that a pin 720 sticks, the motion of actuator 710 is not necessarily imparted to all of the pins 720 substantially concurrently. Instead, a force that is imparted to the actuator 710 may be imparted to all of the pins 720 substantially concurrently. Where resilient devices 740 are respectively coupled between cables 735 and corresponding pins 720, the motion imparted to actuator 710 is substantially concurrently (e.g., concurrently) imparted to resilient devices 740, causing the resilient devices 740 to be stretched substantially concurrently (e.g., concurrently) so that the resilient devices 740 substantially concurrently (e.g., concurrently) exert forces on the respective pins 720.

When station 100 is in its closed, portable configuration of FIG. 1, with closed chest 105 positioned within enclosure 102, pins 720 may respectively extend into the lowermost openings 820, thereby selectively fastening closed chest 105 to enclosure 102 and preventing closed chest 105 from being pulled out of open enclosure 102. This enables station 100 to be lifted and transported by handle 110. When station 100 is in its open configuration of FIG. 4, with chest 105 being open, pins 720 may respectively extend into the uppermost openings 820 or any of the openings 820 between the lowermost and uppermost openings 180, for example, thereby selectively fastening open cases $\mathbf{106}_1$ and $\mathbf{106}_2$ to enclosure 102, that is acting as a base for station 100 in the open configuration of station 100.

A distance H (e.g., vertical distance) between the bottom surface 850 chest 105 and the bottom interior surface 854 of open enclosure 102 may be changed by using actuator 710 to selectively retract pins 720 from their respective openings 820 and then moving chest 105, while keeping the pins 720 retracted by maintaining a force on actuator 710 (e.g., keeping actuator 710 depressed), until pins 720 align with another set of openings 820, corresponding to a different distance H, and releasing actuator 710 so that the biasing forces of the respective biasing devices 730 cause the respective pins 720 to move into that set of openings 820. In this way, the distance H, and thus the elevation of chest 105 within open enclosure 102, is selectively adjustable. Note that the distance H establishes the height of station 100, e.g., the distance of table 140 above the bottom surface 147 of enclosure 102, when station 100 is in the open configuration of FIG. 4.

To move chest 105 from the position, e.g., the elevation within enclosure 102, it is at when station is in the closed, portable configuration of FIG. 1 to the open configuration of FIG. 4, chest 105, while closed, is first moved to the position, e.g., elevation within enclosure 102, shown FIG. 2, from the position in FIG. 1. In an example, to move closed chest 105 from the position of FIG. 1 to the position in FIG. 2, actuator 710 is used to selectively retract pins 720 from the lowermost set openings 820; chest 105 is then moved, while keeping the pins 720 retracted by maintaining a force on actuator 710 (e.g., keeping actuator 710 depressed), until pins 720 align with any set of openings 820 above the lowermost set, depending on the desired height of the opened station 100; and actuator 710 is released so that the biasing forces of the respective biasing devices 730 cause the respective pins 720 to move into that set of openings 820. Once chest 105 is located as shown in FIG. 2, chest 105 can be subsequently opened (e.g., unfolded), as shown in FIGS. 2-4.

Similarly, to position station 100 in the closed, portable configuration in FIG. 1 from the open configuration of FIG. 4, chest 105 is closed, as shown in FIGS. 4-2. Then, in an example, with chest 105 positioned as shown in FIG. 2, actuator 710 is used to selectively retract pins 720 from the present set of openings 820; chest 105 is then moved, while keeping the pins 720 retracted by maintaining a force on actuator 710 (e.g., keeping actuator 710 depressed), until pins 720 align with the lowermost set openings 820; and actuator 710 is released so that the biasing forces of the respective biasing devices 730 cause the respective pins 720 to move into the lowermost set of openings 820.

Note that chest 105 is selectively fastened to open enclosure 102 by pins 720, in that pins 720 can be selectively retracted to selectively unfasten chest 105 from open enclosure 102.

For other embodiments, pins 720 may be coupled to electrically activated actuators, such as solenoids, that retract pins 720 in response to selectively receiving electrical signals. For such embodiments, actuator 710 may close a normally open switch to selectively electrically couple a power source to each of the solenoids for sending the electrical signals to each of the solenoids.

Figure 10:
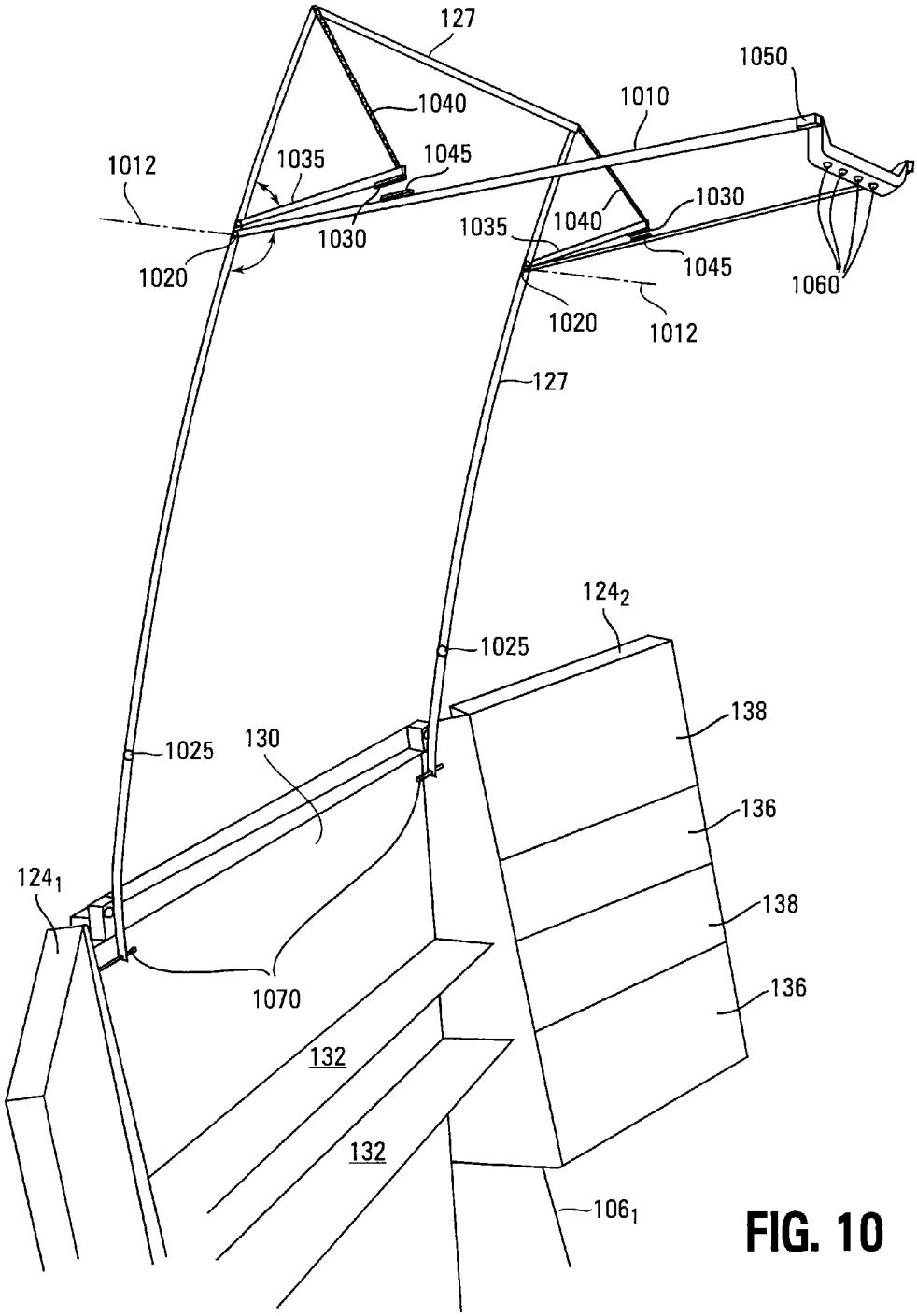
FIG. 10 illustrates a light boom of a portable station, according to another embodiment.

FIG. 10 illustrates a light boom 1010. For some embodiments, light boom 1010 may be pivotally coupled to a frame by hinges 1020 so that light boom 1010 may pivot about a pivot axis 1012 that may be substantially parallel to the pivot axis 115 about which case $\mathbf{106}_1$ pivots. For some embodiments, the frame may be the frame 127 of the pocket assembly 125 (FIG. 4), as shown in FIG. 10 without the sheet 128 of compliant material and the pockets 129 of pocket assembly 125. Light boom 1010 may be removably coupled to frame 127 in a non-extended position by magnets 1025 attached to frame 127. For example, light boom 1010 may be located in its non-extended position when frame 127 is pivoted into compartment 130, such as when pocket assembly 125 is covered by cases $\mathbf{124}_1$ and $\mathbf{124}_2$, when cases $\mathbf{124}_1$ and $\mathbf{124}_2$ are located in front of compartment 130 (FIG. 3).

Light boom 1010 may be pivoted from contact with magnets 1025 to the extended position shown in FIG. 10 and into to contact with magnets 1030 that removably couple light boom 1010, in its extended position, to bars 1035 that are pivotally coupled to frame 127 and that may respectively pivot about pivot axes that may be substantially parallel to the pivot axis 1012 about which light boom 1010 pivots. Note that bars 1035 pivotally couple their respective magnets to frame 127.

Flexible supports 1040, such as strips of fabric, e.g., nylon web, leather, etc., respectively couple bars 1035, e.g., at their distal ends, to the frame 127. Flexible supports 1040 allow bars 1035 to pivot against frame 127 when frame 127 is pivoted into compartment 130.

For some embodiments, light boom 1010 may be fabricated from a ferrous magnetic material, such as steel, for removably coupling to magnets 1025 and 1030. Alternatively, for other embodiments, light boom 1010 may be fabricated from a non-magnetic material, such as aluminum, in which case patches 1045 of ferrous magnetic material, such as steel, may be attached to light boom 1010 for respectively contacting magnets 1030, and patches 1050 of ferrous magnetic material, such as steel, may be attached to light boom 1010 for respectively contacting magnets 1025.

Light boom 1010 includes one or more light sources 1060, such as LEDs, coupled to light boom 1010 distally from frame 127. Light sources 1060 may be electrically coupled to a DC power source, e.g., located on board station 100 (not shown). Light sources 1060 may be electrically coupled to the DC power source through a switch that can selectively turn light sources 1060 on and off. For some embodiments, the switch may be a pulse-code-modulated dimmer that can selectively adjust the intensity (e.g., brightness) of light sources 1060.

FIG. 10 further illustrates that frame 127, and thus pocket assembly 125 (FIG. 4), may be pivotally coupled to the interior surfaces of the opposing sidewalls of case $\mathbf{106}_1$ by pins 1070.

Figure 11:
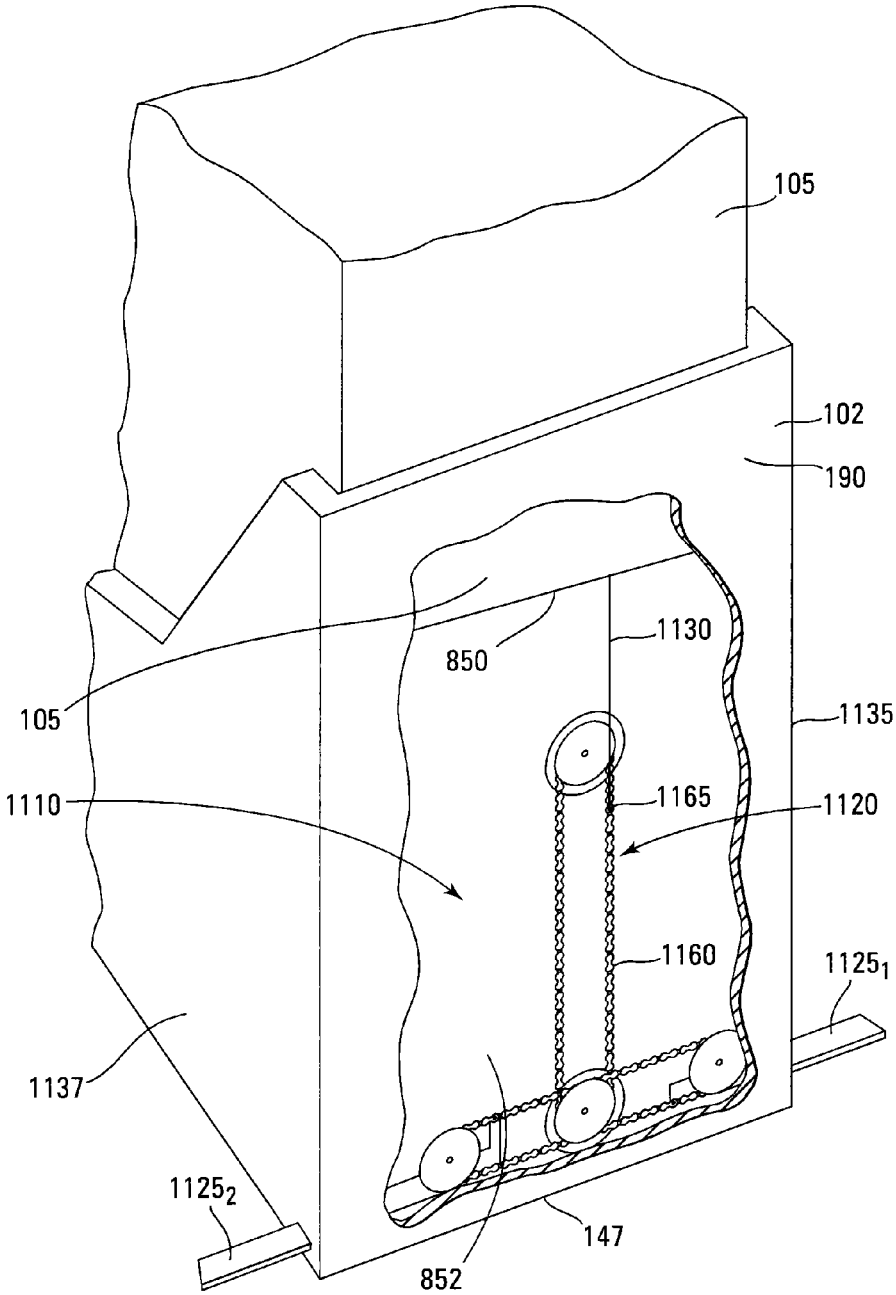
FIG. 11 is a perspective right side view of the portable station in FIG. 2 with a portion of a sidewall removed, according to another embodiment.

FIG. 11 is a perspective right side view of the portable station 100 in FIG. 2 with a portion of sidewall 190 of open enclosure 102 removed. A stabilizer assembly 1110 may be located in a space 852 (FIGS. 8 and 12) within enclosure 102 between the bottom interior surface 854 of enclosure 102 and the bottom surface 850 of chest 105, as shown in FIG. 11. For some embodiments, there may be a pair of stabilizer assemblies 1110, where the stabilizer assemblies 1110 are located adjacent to the opposing sidewalls 190 of enclosure 102.

Each stabilizer assembly 1110 may include a drive 1120 coupled to a stabilizer $\mathbf{1125}_1$ that may be selectively extendable from the front 1135 (FIGS. 2, 3, 4, and 11) of enclosure 102 and a stabilizer $\mathbf{1125}_2$ that may be selectively extendable from the back 1137 (FIG. 11) of enclosure 102. Note that the two stabilizers $\mathbf{1125}_1$ shown in FIGS. 2-4 may be respectively of the stabilizer assemblies 1110 of the pair of stabilizer assemblies 1110.

The drive 1120 of each stabilizer assembly may be coupled to chest 105 by a linkage 1130, e.g., a connecting rod, and is thus responsive to the movement of chest 105. Moving chest 105 from the position (FIG. 1), e.g., the elevation within enclosure 102, it is at when station is in the closed, portable configuration to the position, e.g., elevation within enclosure 102, shown FIG. 2 causes the respective drives 1120 to extend the stabilizers $\mathbf{1125}_1$ from the front 1135 and stabilizers $\mathbf{1125}_2$ from the back 1137 of enclosure 102. For some embodiments, stabilizers $\mathbf{1125}_1$ and stabilizers $\mathbf{1125}_2$ may angle downward from vertical to engage the surface on which portable station 100 is positioned.

Moving chest 105 from the position of FIG. 2 to the position of FIG. 1 causes the respective drives 1120 to retract the stabilizers $\mathbf{1125}_1$ into enclosure 102 through the front 1135 and stabilizers $\mathbf{1125}_2$ into enclosure 102 through the back 1137 of enclosure 102. Note that for other embodiments, a single stabilizer assembly 1110 may be used, and a single drive 1120 may be configured to drive both of stabilizers $\mathbf{1125}_1$ and both of stabilizers $\mathbf{1125}_2$.

As such, the stabilizers 1125 are responsive to moving chest 105 relative to enclosure 102. Stated in a different way, stabilizers 1125 are configured to extend from enclosure 102 in response to moving chest 105 from the elevation within enclosure 102 it is at when station is in the closed, portable configuration in FIG. 1 to the elevation within enclosure 102 it is at when station is in open configuration in FIG. 4, and stabilizers 1125 are configured to retract into enclosure 102 in response to moving chest 105 from the elevation within enclosure 102 it is at when station is in the open configuration to the elevation within enclosure 102 it is at when station is in closed, portable configuration.

Figure 12:
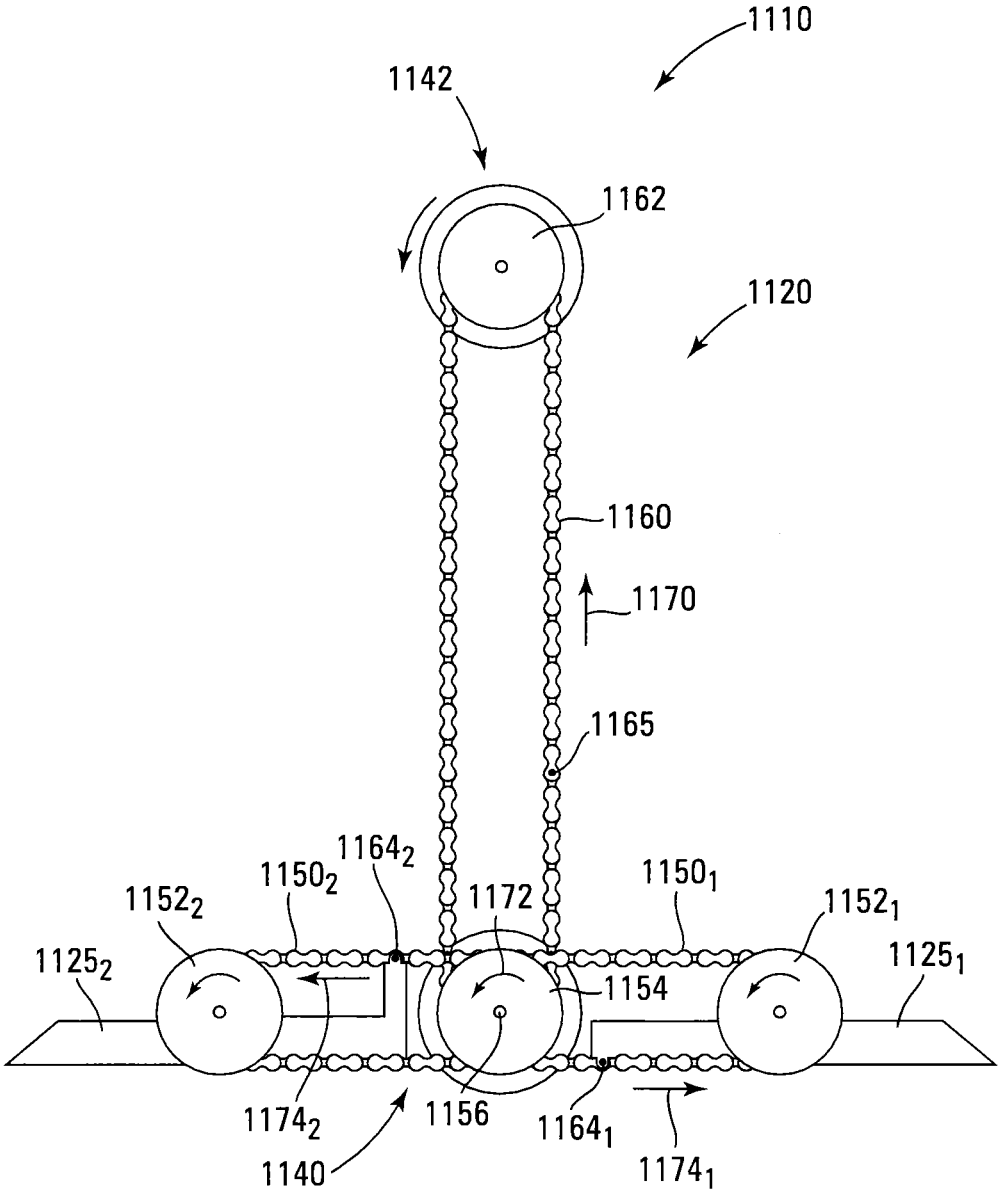
FIG. 12 illustrates a stabilizer assembly with the stabilizers retracted, according to another embodiment.
Figure 13:
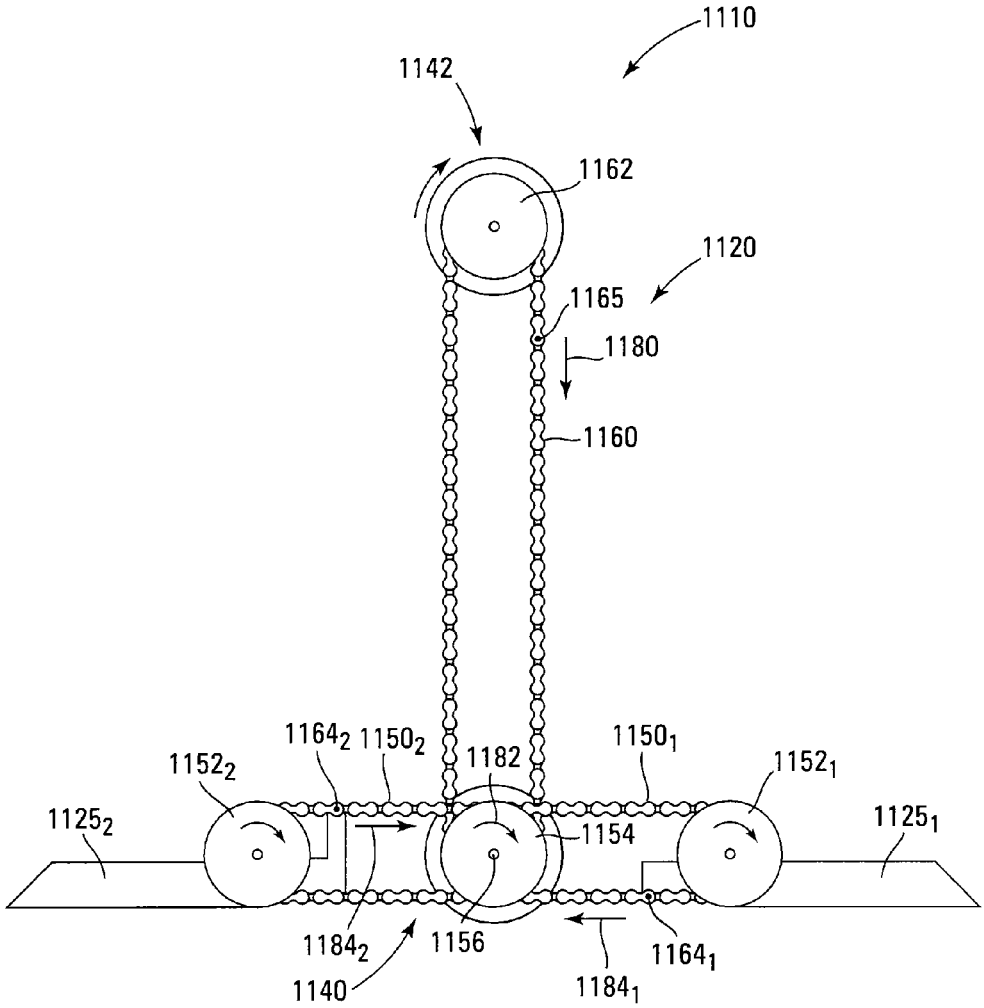
FIG. 13 illustrates a stabilizer assembly with the stabilizers extended, according to another embodiment.

FIGS. 12 and 13 illustrate the details of a stabilizer assembly 1110, for an embodiment. FIGS. 12 and 13 respectively illustrate stabilizer assembly 1110 with the stabilizers $\mathbf{1125}_1$ and stabilizers $\mathbf{1125}_2$ retracted and with the stabilizers $\mathbf{1125}_1$ and stabilizers $\mathbf{1125}_2$ extended. Stabilizer assembly 1110 may include an output drive assembly 1140 and an input drive assembly 1142 coupled to output drive assembly 1140, where the input drive assembly 1142 is configured to drive output drive assembly 1140 in response to the movement of chest 105 within open enclosure 102 and where output drive assembly 1140 is configured to extend or retract stabilizers 1125 in response to being driven by input drive assembly 1142.

Output drive assembly 1140 may include a belt (or a chain) $\mathbf{1150}_1$ wrapped around a pulley (or a sprocket) $\mathbf{1152}_1$ and a first pulley 1154. Belt $\mathbf{1150}_1$ is coupled to a stabilizer $\mathbf{1125}_1$ at a connection point $\mathbf{1164}_1$ on belt $\mathbf{1150}_1$, e.g., by a pin, as shown in FIGS. 11 and 12. Output drive assembly 1140 may include a belt (or a chain) $\mathbf{1150}_2$ wrapped around a pulley (or a sprocket) $\mathbf{1152}_2$ and a second pulley 1154 (not shown) that is coupled to the first pulley 1154 by a shaft 1156 and that is obscured from view by the first pulley 1154. Belt $\mathbf{1150}_2$ is coupled to a stabilizer $\mathbf{1125}_2$ at a connection point $\mathbf{1164}_2$ on belt $\mathbf{1150}_2$, e.g., by a pin, as shown in FIGS. 11 and 12.

Input drive assembly 1142 may include a belt (or a chain) 1160 wrapped around a pulley (or a sprocket) 1162 and a pulley (or a sprocket) (not shown) that is coupled to first and second pulleys 1154 by shaft 1156 and that is obscured from view by the first pulley 1154. Belt 1160 may be coupled to linkage 1130 at a connection point 1165 on belt 1160, e.g., by a pin, as shown in FIGS. 11-13. For embodiments where there is a single stabilizer assembly 1110 and a single drive 1120, the drive 1120 may include two output assemblies 1140, one coupled to the stabilizers $\mathbf{1125}_1$ and $\mathbf{1125}_2$ adjacent to one of the sidewalls 190 of enclosure 102 and the other coupled to the stabilizers $\mathbf{1125}_1$ and $\mathbf{1125}_2$ adjacent to other of the sidewalls 190, and where the pulleys 1154 of the respective output assemblies 1140 are coupled to the shaft 1156 so that both output assemblies 1140 are coupled to input drive assembly 1142.

Moving chest 105, e.g., lifting chest 105, from the position of FIG. 1 to the position of FIG. 2 causes linkage 1130 to move belt 1160 in the direction of arrow 1170, as shown in FIG. 12, e.g., connection point 1165 is moved upward in the direction of arrow 1170 from the location in FIG. 12 to the location in FIG. 13. Moving belt in the direction of arrow 1170 causes shaft 1156, and thus the first and second pulleys 1154, to rotate in the direction of arrow 1172. The motion of first pulley 1154 in turn causes belt $\mathbf{1150}_1$ to move attachment point $\mathbf{1164}_1$ and stabilizer $\mathbf{1125}_1$ in the direction of arrow $\mathbf{1174}_1$ so that stabilizer $\mathbf{1125}_1$ extends from the front 1135 of enclosure 102. The motion of second pulley 1154 in turn causes belt $\mathbf{1150}_2$ to move attachment point $\mathbf{1164}_2$ and stabilizer $1125_2$ in the direction of arrow $1174_2$ so that stabilizer $1125_2$ extends from the back 1137 of enclosure 102.

For embodiments where there is a single stabilizer assembly 1110 and a single drive 1120 coupled to two output assemblies 1140, drive 1120 causes each of the two output assemblies 1140 to extend the respective stabilizers $1125_1$ and $1125_2$ respectively from the front 1135 and the back 1137 of enclosure 102 in response to lifting case 105 from the position of FIG. 1 to the position of FIG. 2 in the manner just described. For embodiments where there are two stabilizer assemblies 1110, lifting case 105 from the position of FIG. 1 to the position of FIG. 2 causes the respective stabilizer assemblies 1110 extend their respective stabilizers $1125_1$ and $1125_2$ respectively from the front 1135 and the back 1137 in the manner just described.

Moving chest 105, e.g., lowering chest 105, from the position of FIG. 2 to the position of FIG. 1 causes linkage 1130 to move belt 1160 in the direction of arrow 1180, as shown in FIG. 13, e.g., connection point 1165 is moved downward in the direction of arrow 1180 from the location in FIG. 13 to the location in FIG. 12. Moving belt in the direction of arrow 1180 causes shaft 1156, and thus the first and second pulleys 1154, to rotate in the direction of arrow 1182. The motion of first pulley 1154 in turn causes belt $1150_1$ to move attachment point $1164_1$ and stabilizer $1125_1$ in the direction of arrow $1184_1$ so that stabilizer $1125_1$ retracts into enclosure 102. The motion of second pulley 1154 in turn causes belt $1150_2$ to move attachment point $1164_2$ and stabilizer $1125_2$ in the direction of arrow $1184_2$ so that stabilizer $1125_2$ retracts into enclosure 102.

For embodiments, where there is a single stabilizer assembly 1110 and a single drive 1120 coupled to two output assemblies 1140, drive 1120 causes each of the two output assemblies 1140 to retract the respective stabilizers $1125_1$ and $1125_2$ in response to lowering case 105 from the position of FIG. 2 to the position of FIG. 1 in the manner just described. For embodiments where there are two stabilizer assemblies 1110, lowering case 105 from the position of FIG. 2 to the position of FIG. 1 causes the respective stabilizer assemblies 1110 retract their respective stabilizers $1125_1$ and $1125_2$ in the manner just described.

In some embodiments, an example method of operating a portable station, such as portable station 100, includes retracting a plurality of pins, such as pins 720, from an open enclosure, such as open enclosure 102, into a closed chest, such as chest 105, in response to receiving a force at the plurality of pins from an actuator, such as actuator 710, to release the chest from the open enclosure so that the chest can be moved from a first elevation within the open enclosure to a second elevation within the open enclosure. The method may also include extending the plurality of pins from the chest into open enclosure when the chest is at the second elevation.

The method may further include pivoting a table, such as table 140, from a first position when the chest is closed to a second position when the chest is open in response to opening the chest when the chest is at the second elevation. The method may further include changing a direction of the force from the actuator at an inverter, such as inverter 760, before receiving the force at some of the plurality of pins.

The chest may include a first case, such as case $106_1$, and a second case, such as case $106_2$, and the method may further include latching the first case to the second case upon receiving the first case atop the second case (FIGS. 3 and 4) in response to the first case pivoting relative to the second case as the chest is being opened at the second elevation.

The plurality of pins may be a plurality of first pins and latching the first case to the second case may include deflecting a second pin, such as a pin 170, into the first case using a plate, such as a plate 160, connected to the second case in response to the first case pivoting relative to the second case, and directing the second pin through an opening, such as an opening 162, in the plate when the pin aligns with the opening.

When the case is open at the second elevation and the first case is latched to the second case, the method may further include retracting the second pin into the first case from the opening in the plate connected to the second case in response to receiving a force at the second pin from a second actuator, such as an actuator 176, where retracting the second pin from the opening in the plate unlatches the first case from the second case, allowing the first case to pivot relative to the second case to close the chest.

Receiving the force at the plurality of pins, such as pins 720, from the actuator, such as actuator 710, may include stretching each of a plurality of resilient devices, such as resilient devices 740, in response to receiving the force at each resilient device from the actuator, and receiving the force at each of the plurality of pins from respective ones of the plurality of stretched resilient devices.

The method may further include moving the chest from the first elevation within the open enclosure to the second elevation within the open enclosure after retracting a plurality of pins from the open enclosure into the closed chest and extending a plurality of stabilizers, such as stabilizers 1125, from the open enclosure or retracting the plurality of stabilizers into the open enclosure in response to moving the chest from the first elevation within the open enclosure to the second elevation within the open enclosure.

CONCLUSION

Although specific embodiments have been illustrated and described herein, it is manifestly intended that these embodiments not be taken in a limiting sense.

What is claimed is:

1. A portable station, comprising:

an open enclosure;

a chest comprising first and second cases pivotally coupled to each other;

a plurality of selectively actuatable pins extending from the second case for selectively fastening the chest at a first location within the open enclosure and for selectively fastening the chest at a second location within the open enclosure; and an inverter in the second case coupled to a single actuator and to first and second pins of the plurality of selectively actuatable pins, where the first and second pins respectively extend in first and second directions that are substantially opposite to each other through opposing sidewalls of the second case;

wherein the inverter is configured to receive a force in a third direction from the single actuator and to output the received force in third direction to the first pin and to change the received force in the third direction to a force in a fourth direction that is substantially opposite to the third direction and output the force in the fourth direction to the second pin;

wherein when the portable station is in a first configuration, the chest is closed and is selectively fastened at the first location within the open enclosure;

wherein when the portable station is in a second configuration, the chest is open and selectively fastened at the second location within the open enclosure; and wherein when the chest is open, the first and second cases have been pivoted apart so that the first case is vertically above the second case.

2. The portable station of claim 1, further comprising a third case pivotally coupled to the first case.

3. The portable station of claim 2, further comprising a container pivotally coupled to the third case so that the container can pivot into and out of the third case.

4. The portable station of claim 3, further comprising a cover pivotally coupled to the third case so that the cover can pivot over at least a portion of the container after the container is pivoted into the third case.

5. The portable station of claim 1, further comprising a table pivotally coupled to the chest that can pivot in response to opening and closing the chest and that extends outward from an interior of the chest when the chest is open.

6. The portable station of claim 5, wherein the table is configured to pivot relative to the second case substantially concurrently with the first case as the chest is opened.

7. The portable station of claim 1, further comprising a pocket assembly pivotally coupled to the first case.

8. The portable station of claim 1, further comprising a light boom pivotally coupled to a frame that is pivotally coupled to the first case.

9. The portable station of claim 8, further comprising a magnet coupled to a bar pivotally coupled to the frame, the magnet for removably coupling the light boom in an extended position when the portable station is in the second configuration.

10. The portable station of claim 8, further comprising a dimmer electrically coupled to light sources that are coupled to the light boom.

11. The portable station of claim 1, further comprising a shelf located within the first case.

12. The portable station of claim 1, wherein the plurality of selectively actuatable pins are a plurality of selectively actuatable first pins, and further comprising a pair of selectively actuatable second pins passing through opposing sidewalls of the first case and extending from opposing outer surfaces of the first case, wherein when the chest is open, the selectively actuatable second pins pass through openings in plates that extend from the second case.

13. The portable station of claim 1, further comprising a plurality of stabilizers configured to extend from the enclosure in response to moving the chest from the first location within the enclosure to the second location within the enclosure.

14. The portable station of claim 1, wherein the single actuator is coupled to the inverter by a single cable and wherein the inverter is respectively coupled to the first and second pins by individual cables.

15. The portable station of claim 14, further comprising a resilient device coupled between each of the individual cables and the first and second pins.

16. A portable station, comprising:

an open enclosure;

a chest comprising first and second cases pivotally coupled to each other;

a table pivotally coupled to the second case and contained within the chest when the chest is closed;

a plurality of selectively actuatable pins extending from the second case for selectively fastening the chest at a first elevation within the open enclosure and for selectively fastening the chest at a second elevation within the open enclosure; and an inverter in the second case coupled to a single actuator and to first and second pins of the plurality of selectively actuatable pins, where the first and second pins respectively extend in first and second directions that are substantially opposite to each other through opposing sidewalls of the second case;

wherein the inverter is configured to receive a force in a third direction from the single actuator and to output the received force in third direction to the first pin and to change the received force in the third direction to a force in a fourth direction that is substantially opposite to the third direction and output the force in the fourth direction to the second pin;

wherein the chest is selectively located at the first elevation within the open enclosure when the chest is closed;

wherein the chest is selectively movable to the second elevation within the open enclosure from the first elevation when the chest is closed;

wherein the table is configured to pivot substantially concurrently with the first case in response to the first case being pivoted relative to the second case to open the chest when the chest is at the second elevation within the open enclosure; and wherein the table extends from an interior of the second case when the chest is opened.

17. The portable station of claim 16, wherein the plurality of selectively actuatable pins are a plurality of selectively actuatable first pins, and further comprising a pair of selectively actuatable second pins passing through opposing sidewalls of the second case and extending from opposing outer surfaces of the second case, wherein when the chest is open, the selectively actuatable second pins pass through openings in plates that extend from the first case.

18. The portable station of claim 16, wherein the single actuator is coupled to the inverter by a single cable and wherein the inverter is respectively coupled to the first and second pins by individual cables.

19. A portable station, comprising:

an open enclosure;

a chest comprising first and second cases pivotally coupled to each other, the chest selectively movable between first and second elevations within the open enclosure; and a stabilizer assembly coupled to the chest and comprising first and second stabilizers;

wherein the stabilizer assembly is configured to cause the first and second stabilizers to extend in opposite directions from the open enclosure in response to moving the chest while closed from the first elevation to the second elevation; and wherein the stabilizer assembly is configured to cause the first and second stabilizers to retract into the open enclosure in opposite directions in response to moving the chest while closed from the second elevation to the first elevation.

20. The portable station of claim 19, wherein the first stabilizer extends from a front of the open enclosure and the second stabilizer extends from a back of the open enclosure in response to moving the chest while closed from the first elevation to the second elevation.

21. A method of operating a portable station, comprising:

retracting a plurality of pins from an open enclosure into a chest, in response to receiving a force at the plurality of pins from a single actuator, to release the chest from the open enclosure so that the chest can be moved from a first elevation within the open enclosure to a second elevation within the open enclosure; and extending the plurality of pins from the chest into the open enclosure when the chest is at the second elevation;

wherein receiving the force at the plurality of pins from the single actuator comprises:

receiving the force from the single actuator in a first direction at a first pin of the plurality of pins that extends in a second direction into the open enclosure through a sidewall of chest; and changing the force from the single actuator from the first direction to a third direction that is substantially opposite to the first direction at an inverter and receiving the force in the third direction from the inverter at a second pin of the plurality of pins that extends in a fourth direction into the open enclosure through an opposing sidewall of chest, where the fourth direction is substantially opposite to the second direction.

22. The method of claim 21, further comprising pivoting a table from a first position when the chest is closed to a second position when the chest is open in response to opening the chest when the chest is at the second elevation.

23. The method of claim 21, wherein the chest comprises first and second cases, and further comprising latching the first case to the second case upon receiving the first case atop the second case in response to the first case pivoting relative to the second case as the chest is being opened at the second elevation.

24. The method of claim 23, wherein latching the first case to the second case comprises:

deflecting a third pin into the first case using a plate connected to the second case in response to the first case pivoting relative to the second case; and directing the third pin through an opening in the plate when the third pin aligns with the opening.

25. The method of claim 23, wherein the actuator is a first actuator and the plurality of pins is a plurality of first pins, and when the case is open at the second elevation and the first case is latched to the second case, further comprising retracting a second pin into the first case from an opening in a plate connected to the second case in response to receiving a force at the second pin from a second actuator, wherein retracting the third pin from the opening in the plate unlatches the first case from the second case, allowing the first case to pivot relative to the second case to close the chest.

26. The method of claim 21, wherein receiving the force from the single actuator in the first direction at the first pin of the plurality of pins comprises:

stretching a resilient device in response to receiving the force from the single actuator in the first direction at the resilient device; and receiving the force in the first direction at the first pin from the stretched resilient device.

27. The method of claim 21, further comprising:

moving the chest while closed from the first elevation within the open enclosure to the second elevation within the open enclosure after retracting the plurality pins from the open enclosure into the closed chest; and extending stabilizers in opposite directions from the open enclosure or retracting the stabilizers in opposite directions into the open enclosure in response to moving the chest while closed from the first elevation within the open enclosure to the second elevation within the open enclosure.

* * * * *